US005389117A

United States Patent [19]

Firey

[11] Patent Number: 5,389,117

[45] **Date of Patent: * Feb. 14, 1995**

[54] CROSS FLOW CHAR FUEL GAS PRODUCERS

[76] Inventor: Joseph C. Firey, P.O. Box 15514, Seattle, Wash. 98115

[ * ] Notice: The portion of the term of this patent subsequent to May 5, 2009 has been disclaimed.

[21] Appl. No.: 75,286

[22] Filed: Jun. 11, 1993

Related U.S. Application Data

[63] Continuation-in-part of Ser. No. 774,608, Oct. 10, 1991, abandoned.

[51] Int. Cl.[6] ..... C10J 3/20

[52] U.S. Cl. ..... 48/76; 48/77; 48/61; 48/203; 48/210; 110/229; 110/254; 422/110

[58] Field of Search ..... 118/61–63, 118/76–77, 99, 101, 106, 203, 210, 213; 422/110–111; 110/229, 254

[56] References Cited

U.S. PATENT DOCUMENTS

| | | | |
|---|---|---|---|
| 4,213,404 | 7/1980 | Spaulding | 110/229 |
| 4,372,256 | 2/1983 | Firey | 123/23 |
| 4,659,340 | 4/1987 | Weaver | 110/229 |
| 4,747,355 | 5/1988 | Van Berkum | 110/229 |
| 4,971,599 | 11/1990 | Cordell et al. | 110/229 |
| 5,138,957 | 8/1992 | Morey et al. | 110/229 |

*Primary Examiner*—Robert J. Warden
*Assistant Examiner*—Hien Tran

[57] ABSTRACT

Reacted gas manifolds and reactant gas manifolds are added to the char fuel reaction chamber of a char fuel gas producer in order to create a flow of gas across the direction of motion of the solid char fuel. The char fuel volatile matter can then be mixed with air and this mixture separated from the producer gas created in the high temperature rapid reaction zone. Improved utilization of char fuel volatile matter can be achieved together with a reduction of tar formation.

11 Claims, 3 Drawing Sheets

CROSS FLOW CHAR FUEL GAS PRODUCERS

CROSS REFERENCE TO RELATED APPLICATIONS

This application is a continuation in part of my earlier filed U.S. patent application entitled, "Cross Flow Char Fuel Gas Producers," Ser. No. 07/774608, filed Oct. 10, 1991, now abandoned. The invention described herein is also related to the inventions described in my following earlier filed U.S. patent applications:

(1) *Product Gas Reservoirs for Cyclic Char Burning Engines and Gasifiers*, Ser. No. 07/876303, filed Apr. 30, 1992, now U.S. Pat. No. 5,216,982 issued Jun. 8, 1992.

(2) *Producer Gas Reservoirs for Cyclic Char Fuel Oxidation Reactors*, Ser. No. 07/895739, filed Jun. 9, 1992 now U.S. Pat. No. 5,257,497 issued Nov. 2, 1993.

(3) *Cyclic Char Fuel Oxidation Reactors with Cross Flow Primary Reactors*, Ser. No. 07/935270, filed Aug. 27, 1992, now U.S. Pat. No. 5,231,821 issued Aug. 3, 1993.

The invention described herein is also related to my following recently issued U.S. Patents:

(4) *Cross Flow Primary Reactors for Cyclic Char Burning Engines and Gasifiers*, U.S. Pat. No. 5,109,808, issued May 5, 1992.

(5) *Cyclic Char Fuel Oxidation Reactors with Cross Flow Primary Reactors*, U.S. Pat. No. 5,177,953, issued Jan. 12, 1993.

(6) *Opposed Cross Flow Primary Reactors for Cyclic Char Burning Engines and Gasifiers*, U.S. Pat. No. 5,201,283, issued Apr. 13, 1993.

(7) *Cyclic Char Fuel Oxidation Reactor with Opposed Cross Flow Primary Reactor*, U.S. Pat. No. 5,193,338, issued Mar. 16, 1993.

BACKGROUND OF THE INVENTION (1) Field of the Invention

This invention is in the field of char fuel gas producers wherein a char fuel, such as coal, is reacted with air, or other oxygen containing reactant gas, to form producer gas as product.

(2) Description of the Prior Art

General descriptions of prior art char fuel gas producers are presented in the following reference:

*Gas and Oil Engines and Gas Producers*, L. S. Marks and H. S. McDewell, American Technical Society, Chicago, 1919, Part II, *Gas Producers*, pages 3 through 70.

This reference is incorporated herein by reference thereto.

In a char fuel gas producer, char fuel at high temperature (circa 1500° F. to 2000° F.) is reacted with oxygen from air or other source to form producer gas, one of the principal fuel constituents of which is carbon monoxide. When steam is also used as an additional reactant gas the producer gas will additionally contain hydrogen as a fuel constituent. Pure oxygen or oxygen enriched air are sometimes used as reactant gas to avoid or minimize the presence of diluent nitrogen gas present in the producer gas product. The resulting producer gas product is thus a fuel gas and can be used to fuel industrial furnaces or boilers or engines or electric power plants.

As used herein and in the claims the term char fuel is as defined in U.S. Pat. No. 4,509,957, col. 2, line 58 through 68, and in U.S. Pat. No. 4,455,837, col. 4, line 8 through line 16, and this material is incorporated herein by reference.

A char fuel gas producer comprises a container within which is a char fuel reaction chamber containing char fuel. Oxygen containing reactant gas is supplied into the char fuel reaction chamber to react in a primary reaction with the hot char fuel therein. The resulting producer gas product is removed from the char fuel reaction chamber.

A means for preheating the char fuel within the char fuel reaction chamber is used to bring the char fuel up to that rapid reaction temperature at which it will react rapidly with oxygen in, those gases adjacent to the char fuel surface; while the plant is being started. Thereafter the means for preheating the char fuel can be turned off when the heat of the primary reaction becomes sufficient to keep the char fuel at or above this rapid reaction temperature.

The term "rapid reaction temperature" is used herein and in the claims to mean that temperature of the char fuel at which it will react with the supplied reactant gas containing oxygen gas sufficiently rapidly to maintain the char fuel temperature at or above this rapid reaction temperature due only to the heat of the reaction between the char fuel and this reactant gas. This rapid reaction temperature varies with the kind of char fuel being reacted, the oxygen content of the reactant gas, and the operating conditions prevailing within the char fuel reaction chamber.

For the same reactant gas and operating conditions different char fuels have different rapid reaction temperatures, some charcoals reacting rapidly with air in usual type reactors at temperatures as low as 1200° F. whereas some petroleum coke fuels will only react rapidly with air at temperatures above about 1500° F.

For a particular char fuel and operating condition a higher rapid reaction temperature is required when the oxygen content of the reactant gas is reduced since more of the heat of char and oxygen reaction is diverted to the heating tap of non reactive portions of the reactant gas. Below a certain minimum oxygen content the reaction between the char fuel and the oxygen is too slow to sustain itself by its own heat of reaction, and the term "appreciable oxygen gas content" of reactant is used herein and in the claims to mean an oxygen content greater than this minimum value. Ordinary air, with an oxygen gas content of about 21 volume percent, will usually react readily with most commonly available hot char fuels in reasonably well insulated reaction chambers, and is an example of a reactant gas containing appreciable oxygen gas suitable for use in most gas producers. In some gas producer applications oxygen enriched air or essentially pure oxygen has been used as the reactant gas containing appreciable oxygen gas. Reactant gases containing less oxygen than air, while theoretically useable in gas producers, have rarely, if ever, been so used.

As the char fuel reaction chamber becomes smaller, external heat loss rate increases, and the char fuel must be brought to a higher temperature, and thus higher reaction speed, in order for the char fuel and oxygen gas reaction to be self sustaining. We thus see that the rapid reaction temperature is not a property of the char fuel alone and can only be determined experimentally within the reaction chamber to be used, and with the oxygen containing reactant gas to be used.

As char fuel is reacted to ashes within the char fuel reaction chamber it is replaced by a refuel mechanism means for supplying fresh char fuel into a refuel end of the chamber. The char fuel is thus moved along through the char fuel reaction chamber toward an opposite ash collection end of the chamber. Hence the char fuel being reacted within the char fuel reaction chamber has a direction of motion from the refuel end toward the ash collection end. An ash removal mechanism is used as a means for removing ashes from the char fuel reaction chamber.

As the char fuel within the char fuel reaction chamber moves along in the char fuel motion direction, it is preheated by heat transfer from char fuel portions which are further along and are reacting rapidly with oxygen and thus are at high temperature. Where the char fuel being used is essentially free of volatile matter, as with coke fuel, this preheat zone serves to bring the new char fuel up to its rapid reaction temperature. The char fuel then enters the rapid reaction zone, and carbon reacts therein with oxygen to form producer gas. Beyond the rapid reaction zone in the direction of char fuel motion the char fuel is essentially completely reacted to ashes which pass into an ash collection zone at the end of the char fuel motion path.

When the char fuel being used contains volatile matter, as with bituminous coal, the char fuel preheat zone also serves as a volatile matter distillation zone to remove the volatile matter from the coal, in part by distillation and in part by reaction to volatile products. In the absence of oxygen, appreciable portions of this distilled volatile matter become tars and other portions become fuel gases of essentially hydrocarbon or oxygen containing hydrocarbon type. These tars from coal volatile matter are undesirable in char fuel gas producers as they tend to clog piping and apparatus and are difficult to burn fully in the subsequent uses of the producer gas product.

In prior art gas producers tar formation from coal volatile matter has been successfully reduced by passing the reactant air first into the preheat and volatile matter distillation zone. The emerging volatile matter apparently reacts with oxygen in the air to form oxygenated hydrocarbon type materials which form much less tar. The resulting volatile matter-in-air mixture then passes into the rapid reaction zone. Within the rapid reaction zone the volatile matter-in-air mixture is apparently burned in appreciable part to fully reacted carbon dioxide and steam. The carbon dioxide and steam, plus any unreacted oxygen, then react with carbon in the rapid reaction zone to form producer gas which emerges from the char fuel reaction chamber. One disadvantage of this method for reducing tar formation is that the initial burning of the volatile matter in air mixture on entering the rapid reaction zone creates very high temperatures there and ash fusion and clinkering may result. These clinkers clog up the motion of the char fuel along the char fuel motion direction and may encase carbon particles and thus prevent complete carbon gasification. Another disadvantage of this method for reducing tar formation is that the carbon dioxide and steam created by burnup of the volatile matter-in-air mixture, react much more slowly with hot carbon in the rapid reaction zone to form producer gas.

The volatile matter in air mixture is a gaseous fuel which has a higher energy content per unit volume than that of a producer gas in air mixture. It is a disadvantage of prior art char fuel gas producers that this valuable volatile matter in air mixture is consumed within the gas producer.

SUMMARY OF THE INVENTION

Two reactant gas manifolds are added along the side of a char fuel gas producer and two product reacted gas manifolds are added along the opposite side of the gas producer. These several manifolds are positioned relative to the direction of char fuel motion so that reactant gas containing appreciable oxygen gas passes from one reactant gas manifold, through the zone of volatile matter distillation, and the resulting volatile matter in gas mixture passes into a volatile matter in gas mixture manifold. Additionally reactant gas containing appreciable oxygen gas passes from another reactant gas manifold, through the zone of rapid char fuel reaction, and the resulting producer gas passes into a producer gas manifold. In this way the volatile matter of the char fuel can be premixed with oxygen containing reactant gas, such as air, in order to suppress tar formation, and the resulting volatile matter in gas mixture is kept separate from the producer gas and also does not flow into the high temperature zone of rapid reaction. Thus klinker formation from ash fusion in the rapid reaction zone can be reduced. Also the reactant gases in the rapid reaction zone contain appreciable oxygen which reacts much more readily with the hot char fuel than the carbon dioxide and steam which result with the volatile matter in gas mixture is passed into the rapid reaction zone.

The producer gas manifold can be fitted with a particle separator means and ash particles can then be allowed to carry over into the producer gas manifold. Ash removal from the producer gas manifold is simpler than from the ash collection end of the char fuel reactor since whatever is collected in the producer gas manifold can be removed as ashes without concern for removing unburned char fuel from the char fuel reactor.

DESCRIPTION OF THE PREFERRED EMBODIMENTS

Figure 1:
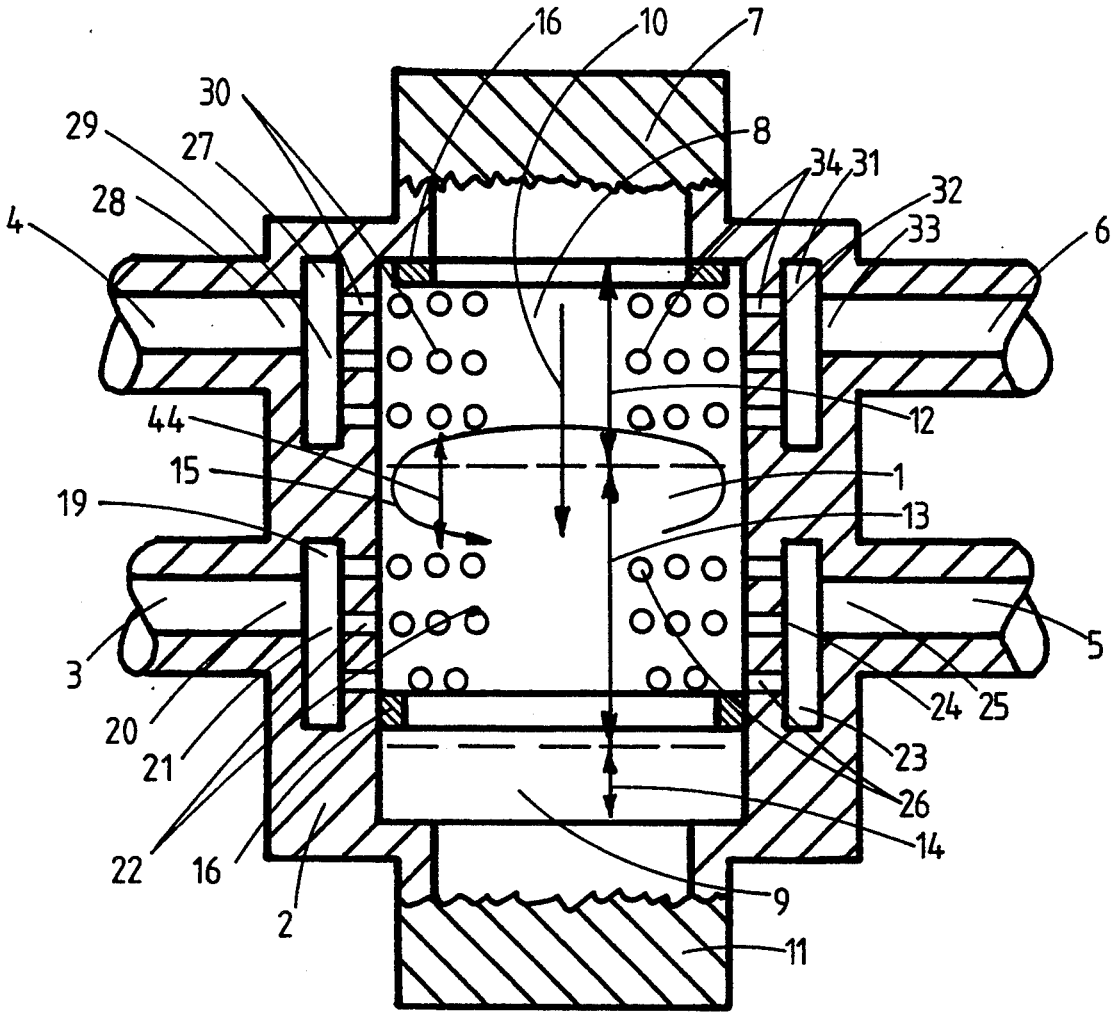
FIG. 1 is a sectional view of the char fuel reaction chamber of the invention.
Figure 2:
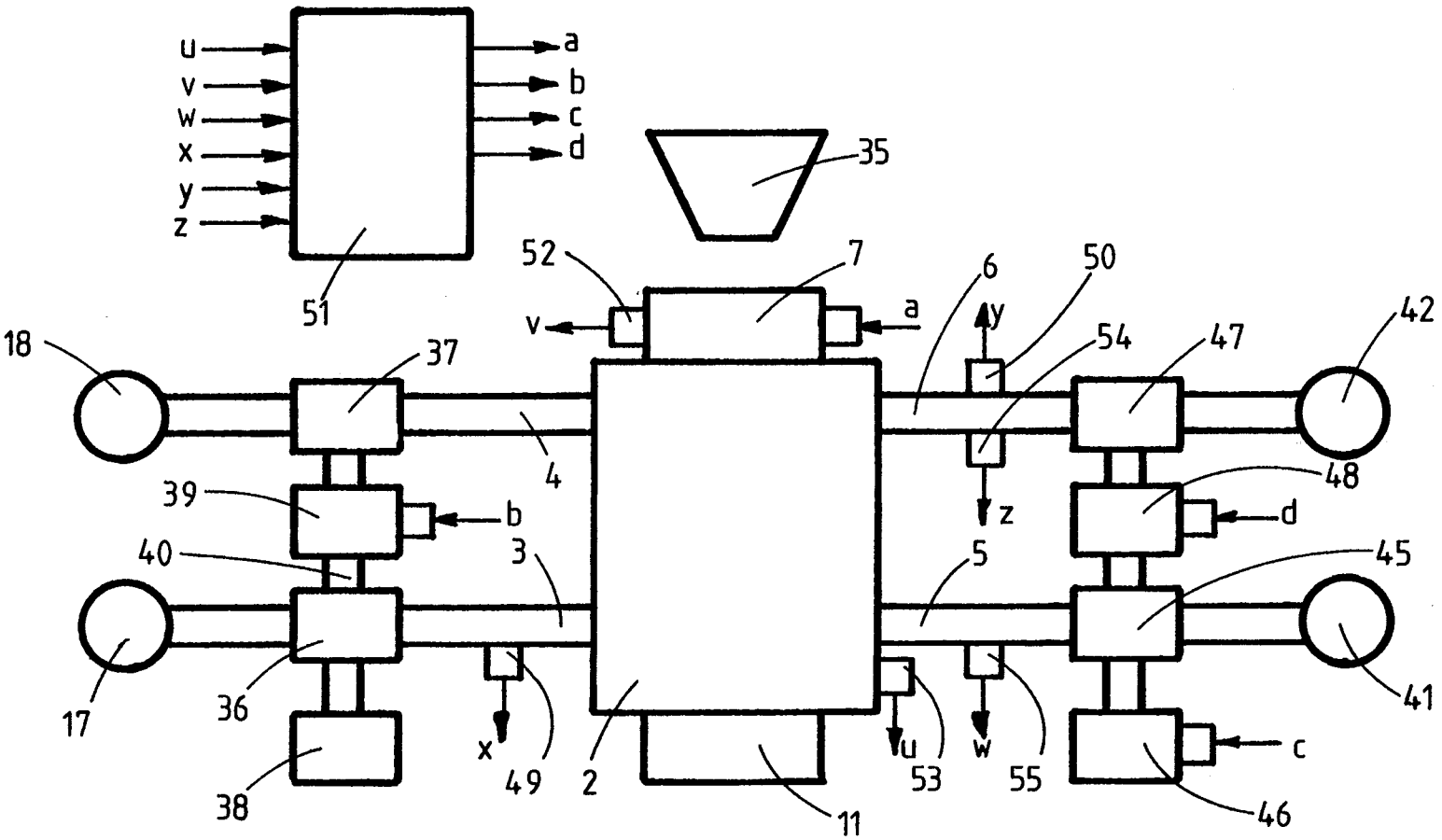
FIG. 2 is a schematic diagram of one form of the char fuel gas producer system of the invention.

An example form of this invention is shown in the cross section in FIG. 1, and in the schematic diagram of FIG. 2, and comprises:

A. A char fuel reactor or reaction chamber, 1, is contained within a container, 2, which may be a pressure vessel container if the char fuel reaction chamber, 1, is operated at pressures above atmospheric. The container, 2, has two separate gas inlets, a first separate container gas inlet, 3, and a second separate container gas inlet, 4, and also two separate gas outlets, a first separate container gas outlet, 5, and a second separate container gas outlet, 6. As char fuel particles (hereinafter referred to as char fuel) are consumed within the reaction chamber, 1, it is replaced from a source of char fuel, 35, into the refuel end, 8, by a refuel means or mechanism, 7, and thus the char fuel is moved along through the reaction chamber, 1, toward the ash collection end, 9, in the char fuel motion direction, 10. Ashes may be removed from the char fuel reaction chamber, 1, by an ash removal means or mechanism, 11, Various types of refuel means, 7, and ash removal means, 11, can be used, some examples of which are described in my following listed U.S. Patents:

U.S. Pat. No. 5,002,024, J. C. Firey, Mar. 26, 1991
U.S. Pat. No. 5,031,397, J. C. Firey, Jul. 16, 1991
U.S. Pat. No. 4,372,256, J. C. Firey, Feb. 8, 1983
U.S. Pat. No. 4,412,511, J. C. Firey, Nov. 1, 1983
U.S. Pat. No. 4,653,436, J. C. Firey, Mar. 31, 1987
U.S. Pat. No. 4,794,729, J. C. Firey, Jan. 3, 1989
U.S. Pat. No. 4,455,837, J. C. Firey, Jun. 26, 1984
U.S. Pat. No. 4,484,531, J. C. Firey, Nov. 27, 1984
U.S. Pat. No. 4,509,957, J. C. Firey, Apr. 9, 1985
U.S. Pat. No. 4,568,361, J. C. Firey, Feb. 4, 1986
U.S. Pat. No. 4,707,991, J. C. Firey, Nov. 24, 1987

The fresh char fuel refueled into the refuel end, 8, of the char fuel reactor, 1, is cold, and will not react with compressed air, but is heated by conduction from those char fuel portions deeper into the char fuel reactor which are at a high temperature and are reacting rapidly with oxygen in a second reactant gas from the second gas inlet to create producer gas. Thus the first portion, 12, of the char fuel reaction chamber along the char fuel motion direction, 10, is a char fuel preheat zone, 12, and distillation of volatile matter takes place here also when char fuels containing volatile matter are being used. At the end of the preheat and volatile matter distillation zone, 12, the char fuel is at or above its rapid reaction temperature and enters the rapid reaction zone portion, 13, of the primary reaction chamber along the char fuel motion path, 10, where char fuel reacts rapidly with oxygen in adjacent compressed first reactant gases, those compressed reactant gases which are adjacent to the char fuel surface, to create a producer gas product, and the heat of this reaction maintains the rapid reaction zone at or above the char fuel rapid reaction temperature. Within the rapid reaction zone, 13, of the char fuel reactor, 1, the carbon of the char fuel is gasified to producer gas and leaves only the ashes which collect in the ash zone, 14, at the ash collection end, 9, of the char fuel motion path, 10.

The char fuel reaction chamber, 1, has a peripheral dimension, 15, around the outer surface of the chamber at right angles to the char fuel motion direction, 10. This peripheral dimension can be divided into an inlet portion, an outlet portion and sealed portions as described hereinbelow.

B. A starting heater means such as electrical heaters, 16, is used for preheating the char fuel in the reactor, 1, up to that temperature at which it reacts rapidly with oxygen in adjacent compressed reactant gas when the gas producer is being started, electrodes of the starting heater means, 16, being used to pass a heating electric current directly through the char fuel itself in the example starting heater shown in FIG. 1. Other types of starting heater means can be used, examples of which are described in my U.S. Patents listed hereinabove.

C. Two separate sources of reactant gas containing appreciable oxygen gas are shown in FIG. 2, a first reactant gas source, 17, and a second reactant gas source, 18. In some forms of this invention a single common source of reactant gas is used. In other forms of this invention two separate sources of reactant gas are used, as shown in FIG. 2, and these two reactant gases may be of a different chemical composition such as differing in oxygen gas concentration or differing in steam concentration.

D. A first reactant gas manifold, 19, with inlet, 20, and outlet, 21, is placed adjacent to the rapid reaction zone, 13, with first reactant gas inlet ports, 22, from the first reactant gas manifold outlet, 21, providing a flow path into thee rapid reaction zone, 13. These first reactant gas inlet ports, 22, are positioned along the length of the char fuel reaction chamber, 1, in the direction of char fuel motion, 10, which is adjacent to the rapid reaction zone, 13, and are positioned around the inlet portion of the peripheral dimension, 15. The first reactant gas manifold inlet, 20, connects to the first separate container gas inlet, 3.

E. A producer gas manifold, 23, with inlet, 24, and outlet, 25, is placed adjacent to the rapid reaction zone, 13, with producer gas outlet ports, 26, providing a flow path into the producer gas manifold inlet, 24, from the rapid reaction zone, 13. These producer gas outlet ports, 26, are positioned along the length of the char fuel reaction chamber, 1, in the direction of char fuel motion, 10, which is adjacent to the rapid reaction zone, 13, and are positioned around the outlet portion of the peripheral dimension, 15, which is essentially opposite the inlet portion used for the first reactant gas inlet ports, 22. The producer gas manifold outlet, 25, connects to the first separate container gas outlet, 5.

F. A second reactant gas manifold, 27, with inlet, 28, and outlet, 29, is placed adjacent to the volatile matter distillation and char fuel preheat zone, 12, with second reactant gas inlet ports, 30, from the second reactant gas manifold outlet, 29, providing a flow path into the volatile matter distillation and char fuel preheat zone, 12. These second reactant gas inlet ports, 30, are positioned along the length of the char fuel reaction chamber, 1, in the direction of char fuel motion, 10, which is adjacent to the volatile matter distillation and char fuel preheat zone, 12, and are positioned around the inlet portion of the peripheral dimension, 15. The second reactant gas manifold inlet, 28, connects to the second separate container gas inlet, 4.

G. A volatile matter in reactant gas mixture manifold, 31, with inlet, 32, and outlet, 33, is placed adjacent to the volatile matter distillation and char fuel preheat zone, 12, with volatile matter in gas mixture outlet ports, 34, providing a flow path from the volatile matter distillation and char fuel preheat zone, 12, into the volatile matter in reactant gas mixture manifold inlet, 32. These volatile matter in gas mixture outlet ports, 34, are positioned along the length of the char fuel reaction chamber, 1, in the direction of char fuel motion, 30, which is adjacent to the volatile matter distillation and char fuel preheat zone, 12, and are positioned around the outlet portion of the peripheral dimension, 15, which is essentially opposite the inlet portion used for the second reactant gas inlet ports, 30. The volatile matter in reactant gas manifold outlet, 33, connects to the second separate container gas outlet, 6.

H. The reactant gas inlet ports, 22, 30, and the producer gas outlet ports, 26, and volatile matter in gas mixture outlet ports, 34, will preferably be smaller in at least one area cross section dimension than the char fuel particles being refueled into the char fuel reaction chamber when small char fuel particles are being used. This dimensional requirement can prevent char particle carryover into the manifolds if the char fuel particles are small enough to be fluidized by the gas flow velocities being used. When larger char fuel particles are being used which will not be fluidized by the prevailing gas flow velocities, this ports dimensional requirements is not needed.

I. The two separate reactant gas manifolds, 19,27, are shown in FIG. 1 on the same side of the char fuel reaction chamber, 1, but this is not necessary. The inlet portion of the peripheral dimension, 15, used for the first reactant gas inlet ports, 22, can be angularly displaced from the inlet portion of the peripheral dimension, 15, used for the second reactant gas inlet ports, 30. By thusly angularly displacing the first reactant gas inlet ports, 22, as much as 180 degrees from the second reactant gas inlet ports, 30, the cross flow of gas through the rapid reaction zone, 13, is opposed to the cross flow of gas through the volatile matter distillation zone, 12. This opposed cross flow increases the heat transferable from the hot gases in the rapid reaction zone to the colder gases in the volatile matter distillation zone and may be preferred in some applications, as, for example, when high volatile matter content char fuels are being used.

J. The producer gas manifold outlet, 25, is connected into a producer gas product collector pipe, 41, via the first separate container gas outlet, 5.

K. The volatile matter in reactant gas manifold outlet, 33, is connected into a volatile matter in gas mixture product collector pipe, 42, via the second separate container gas outlet, 6.

L. A first means for creating a first flow of reactant gas, 36, causes reactant gas to flow from the first reactant gas source, 17, into the first reactant gas manifold, 19, via the first separate container gas inlet, 3, and comprises means for adjusting the flow rate, 38, of this first flow of reactant gas.

M. A second means for creating a second flow of reactant gas, 37, causes reactant gas to flow from tile second reactant gas source, 18, into the second reactant gas manifold, 27, via the second separate container inlet, 4, and comprises means for adjusting the flow rate, 39, of this second flow of reactant gas.

N. A third means for creating a flow of product producer gas, 45, causes producer gas to flow from the producer gas manifold, 23, into the producer gas product collector, 41, via the first separate container gas outlet, 5, and comprises means for adjusting the flow rate, 46, of this producer gas flow.

O. A fourth means for creating a flow of product volatile matter in gas mixture, 47, causes volatile matter in gas mixture to flow from the volatile matter in gas mixture manifold, 31, into the volatile matter in gas mixture collector, 42, via the second separate container gas outlet, 6, and comprises means for adjusting the flow rate, 48, of this volatile matter in gas mixture flow.

P. These several means for creating a flow of gases can be any of several different flow creating means, such as compressors, fans, pumps, etc. The means for adjusting the gas flow rate can be any of several different flow rate adjusting means, such as adjustable speed drive means for the flow creating means, or flow restrictors in the gas flow passages. Combined means for creating a flow of gases can also be used, for example, by use of suction pumps to remove gases from the product manifolds, and with flow restrictors in the reactant gas inlets which, when opened, create a flow of reactant gas into the reactant gas manifolds adjustable by adjustment of the flow restrictor opening.

Q. The beneficial objects of this invention result in large part from keeping the cross flow of reactant gas and producer gas through the rapid reaction zone, 13, largely separated from the cross flow of reactant gas and volatile matter in gas mixture through the volatile matter distillation and char fuel preheat zone, 12. To achieve this separated cross flow, the several gas flow rates, of reactant gases into the reaction chamber, and of product gases out of the reaction chamber, must be proportioned relative to each other so that little or no gas flow occurs between the rapid reaction zone, 13, and the volatile matter distillation and char fuel preheat zone, 12. This proportioning of relative gas flow rates can be achieved by hand adjustment of the several flow rate adjustment means of the gas flow creating means. Preferably, however, this proportioning of relative gas flow rates is achieved by automatic adjustment of the several flow rate adjustment means by use of suitable sensor and control means as described hereinbelow.

The example form of this invention shown in FIGS. 1 and 2 operates as follows when air is used as reactant gas:

1. The char fuel reaction chamber, 1, is filled with char fuel from the source, 35, by the refuel mechanism, 7.
2. The char fuel in at least the rapid reaction zone, 13, is heated up to its rapid reaction temperature by the starting heater means, 16.
3. Air is delivered into the rapid reaction zone, 13, from the reactant gas source, 17, by the first means for creating a first flow of reactant gas, 36, via the first reactant gas manifold, 19, and the first reactant gas inlet ports, 22.
4. Within the rapid reaction zone, 13, the oxygen in the reactant air reacts with the hot char fuel to form producer gas containing carbon monoxide as a principal fuel gas constituent.
5. The producer gas formed in the rapid reaction zone flows into the producer gas manifold, 23, via the producer gas outlet ports, 26, and is then caused to flow into the producer gas product collector, 41, via the first separate container gas outlet, 5, by the third means for creating a flow of product producer gas, 45.
6. The reaction within the rapid reaction zone to form producer gas is exothermic and this heat of reaction keeps the char fuel in the rapid reaction zone at or above its rapid reaction temperature. Some of this heat of the producer gas reaction is transferred into those char fuel portions in the volatile matter distillation and char fuel preheat zone, 12.
7. Air is also delivered into the volatile matter distillation and char fuel preheat zone, 12, from the reactant gas source, 18, by the second means for creating a second flow of reactant gas, 37, via the second reactant gas manifold, 27, and the second reactant gas inlet ports, 30.

8. As the char fuel in the volatile matter distillation and char fuel preheat zone, 12, is heated, the volatile matter is distilled as vapor out of the char fuel and mixes with the incoming reactant air to form a volatile matter in reactant gas mixture.
9. The volatile matter in reactant gas mixture formed in the volatile matter distillation and char fuel preheat zone, 12, flows into the volatile matter in reactant gas manifold, 31, via the volatile matter in reactant gas mixture outlet ports, 34, and is then caused to flow into the volatile matter in reactant gas mixture product collector pipe, 42, via the second separate container outlet, 6, by the fourth means for creating a flow of product volatile matter in gas mixture, 47.
10. Some chemical reactions may occur within the volatile mater distillation and char fuel preheat zone. Some originally solid portions of the char fuel may be decomposed into volatile materials upon heating. Some portions of volatile matter vapor may react with oxygen in the reactant gas to form oxygenated hydrocarbon type gases. These chemical reactions are not usually highly exothermic, however, only small reaction heating resulting.
11. The product gases in the two separate collector pipes, 41, 42, can be used separately as fuel gases for furnaces, boilers, gas turbine engines, piston engines, etc. It is one of the beneficial objects, achievable by use of the devices of this invention, that the high energy content volatile matter in reactant air mixture is kept separate from the low energy content available from the producer gas. These two different fuel gas mixtures can thusly be used in separate applications where their differences can be utilized to best advantage. For example the producer gas product, when admixed with additional secondary air, can be used to fire industrial furnaces such as ceramic kilns, cement kilns, boilers, etc., where its low energy content is not a serious disadvantage. The volatile matter in reactant air mixture product can be used as intake mixture to a piston internal combustion engine where its high energy content will allow use of smaller size engines of lesser weight and lower cost than those required when producer gas is used as engine fuel.
12. The volatile matter in reactant gas mixture can be largely kept out of the rapid reaction zone, 13, by suitable adjustment of the relative flow rates of reactant gases into the reaction chamber and of product gases out of the reaction chamber as described hereinabove. In consequence the volatile matter in gas mixture is not burned to carbon dioxide and water vapor within the rapid reaction zone. By thus preventing the full combustion of the volatile matter in reactant air mixture, appreciable fort nation of slow reacting carbon dioxide and water vapor within the rapid reaction zone is prevented, and the ash fusion and klinker formation consequent upon the high temperatures resulting from such full combustion are prevented or reduced. These are further beneficial objects made available by use of this invention.

Prior art, steady pressure, gas producers have also separated the volatile matter in air mixture from the rapid reaction zone as shown for example in the Westinghouse double zone gas producer. A description of this Westinghouse gas producer is presented in the book, *Gas Engines and Producers*, L. S. Marks and H. S. McDewell, American Technical Society, Chicago, 1919, on page 26 and 27 of the second, *Gas Producers* section therein. This Westinghouse gas producer utilizes gas flow principally along the direction of char fuel motion rather than across this motion direction.

Tar reduction by mixing oxygen into emerging coal volatile matter can be achieved by use of this invention without appreciable burnup of the volatile matter-in-air mixture since this mixture passes largely into the volatile matter-in-air manifold and only small portions may enter the high temperature rapid reaction zone. This tar reduction is an additional beneficial object of this invention.

Char fuels vary greatly in the proportion of volatile matter they contain; fuels such as coke or anthracite contain little or no volatile matter, whereas fuels such as bituminous coal, wood, biomass, etc., may contain well in excess of fifty percent volatile matter by weight. The rate of char fuel reaction into producer gas within the rapid reaction zone determines the rate of char fuel replacement by the refuel mechanism and hence the rate of evolution of volatile matter in the volatile matter distillation and char fuel preheat zone. For a particular char fuel the reactant gas flow rate into the volatile matter distillation zone has a fixed ratio to the reactant gas flow rate into the rapid reaction zone. The volatile matter content of the char fuel, and the desired equivalence ratio of the product volatile matter in reactant gas mixture, also affect this ratio of reactant gas flow rates delivered. Where a cross flow char fuel gas producer is to be used with various char fuels, differing in volatile matter content, this reactant gas flow rates ratio can be made adjustable. The optimum value of this reactant gas flow rates ratio is best determined experimentally for each char fuel in a running cross flow char fuel gas producer. Various criteria of optimization can be chosen. For example, the energy content per unit volume of the volatile matter in reactant gas mixture product could be maximized as measured in a gas calorimeter.

For plant sizing and design purposes an approximate value of the reactant gas mass flow rates ratio can be estimated from the proximate and ultimate analyses of the char fuel, corrected to an ash and moisture free basis (maf basis) by use of the following relations:

(RGR)=Ratio of mass flow rates of reactant gases;

$$(RGR) = \frac{(mFRVM)}{(mFRRR)} = \frac{(A)}{(B)}$$

(mFRVM)=mass flow rate of reactant gas into the volatile matter distillation zone;

(mFRRR)=mass flow rate of reactant gas into the rapid reaction zone;

$$(A) = \left[32\left(n - F + \frac{m}{4} - \frac{r}{2}\right) + 28h\right](SR)$$

$$(B) = \left[32\frac{(F + 2S)}{(2 + y)} + 18y\frac{(F + 2S)}{(2 + y)} + 28g\right]$$

Wherein:

$$n = \frac{(C)(MWC)}{(12)(100)}$$

-continued $$m = \frac{(H)(MWC)}{100)}$$

$$r = \frac{(O)(MWC)}{(16)(100)}$$

$$s = \frac{(G)(MWC)}{(32)(100)}$$

$$t = \frac{(N)(MWC)}{(14)(100)}$$

(MWC)=Assumed char fuel molecular weight. Values of 1000 to 10000 can be used here with no effect on the ratio of flow rates;

C=Wt. percent carbon by ultimate analysis of char fuel; (maf)

H=Wt. percent hydrogen by ultimate analysis of char fuel; (maf)

O=Wt. percent oxygen by ultimate analysis of char fuel; (maf)

G=Wt. percent sulphur by ultimate analysis of char fuel; (maf)

N=Wt. percent nitrogen by ultimate analysis of char fuel; (maf)

These molecular weights and weight percents are for a moisture and ash free char fuel (maf).

$$(F) = \frac{(FC)(MWC) - 32(s) = 14(t)}{12}$$

(FC)=Wt. fraction fixed carbon by proximate analysis (maf) of char fuel;

y=molal ratio of steam to oxygen gas in the reactant gas flowing into the rapid reaction zone;

(SR)=equivalence ratio intended to be used for the product volatile matter in reactant gas mixture;

$$(SR) = \frac{\text{Actual oxygen flow into volatile matter gas mixture}}{\text{Complete combustion oxygen flow into volatile matter gas mixture}}$$

Mass fraction oxygen gas in reactant gas flowing into volatile matter distillation zone $$= \frac{32\left[n - F + \frac{m}{4} - \frac{r}{2}\right]}{32\left[n - F + \frac{m}{2} - \frac{n}{2}\right] + 28h}$$

From this relation a value of h can be calculated. Mass fraction oxygen gas flowing into rapid reaction zone.

$$= \frac{32\left(\frac{F + 2S}{2 + y}\right)}{\left[32\left(\frac{F + 2S}{2 + y}\right) + 18y\left(\frac{F + 2S}{2 + y}\right) + 28g\right]}$$

From this relation a value of g can be calculated.

Approximate values of the ratios of the product gas mass flow rates to the mass flow rate of reactant gas into the rapid reaction zone can be estimated by use of the following relations:

(PPGR)=Ratio of mass flow rate of product producer gas to mass flow rate of reactant gas into the rapid reaction zone;

$$(PPGR) = \frac{mFPPG)}{(mFRRR)} = \frac{(C)}{(B)}$$

(mFPPG)=mass flow rate of product producer gas;

$$(C) = \left[28F + 2y\frac{(F + 2S)}{(2 + y)} + 64S + 28\left(\frac{t}{2} + f\right)\right]$$

(PVMGR)=Ratio of mass flow rate of product volatile matter in gas mixture to mass flow rate of reactant gas into the rapid reaction zone;

$$(PVMGR) = \frac{(mFPVMM)}{(mFRRR)} = \frac{(D)}{(B)}$$

(mFPVMM)=mass flow rate of product volatile matter in gas mixture;

$$(D) = 12(n - F) + m + 16r + (SR)\left[32\left(n - F + \frac{m}{4} - \frac{r}{2}\right) + 28h\right]$$

The mass rate of char fuel refueling into the char fuel reaction chamber can be estimated by use of the following relations:

(CHR)=Ratio of mass flow rate of char fuel into reaction chamber to mass flow rate of reactant gas into the rapid reaction zone;

$$(CHR) = \frac{(mFCH)}{(mFRRR)} = \frac{(E)}{(B)}$$

(MFCH)=Mass flow rate of char fuel into reaction chamber;

(E)=[12n+m+16r+32S+14t]

The foregoing relations can be used for approximate sizing of the reactant gas flow creating means, the product gas flow creating means, and the char fuel refuel means.

When a cross flow char fuel gasifier is in operation these several mass flow rates can be controlled by hand or preferably automatically as follows:

1. The basic rate of char fuel reaction is controlled by the mass rate of flow of reactant gas into the rapid reaction zone via control of the first reactant gas flow creating means, 36. This control can be done by hand or automatically in response to the output demanded from the gasifier.
2. The mass rate of char fuel input into the char fuel reaction chamber can be controlled in proportion to the mass rate of flow or reactant gas into the rapid reaction zone via control of the refuel means, 7. This control can be done by hand or automatically in response to the mass rate of flow of reactant gas into the rapid reaction zone. A refuel mechanism which automatically keeps the reaction chamber full of char fuel is a simple means for controlling char fuel input in proportion to reactant gas flow into the rapid reaction zone. Examples of such automatic filling refuel mechanisms are described in my U.S. Pat. No. 4,653,436, *Untimed*

*Refuel and Ash Removal for Char Burning Engines*, Mar. 31, 1987, col. 2, line 48 through col. 3, line 47; col. 5, line 37 through col. 8, line 59; and FIGS. 1 through 5 inclusive and this material is incorporated herein by reference thereto.

3. The mass rate of flow of reactant gas into the volatile matter distillation zone can be controlled in proportion to the mass rate of flow of reactant gas into the rapid reaction zone by control of the second reactant gas flow creating means, 37, as, for example by adjustment of a variable ratio drive means, 39, connecting via, 40, to the drive means, 38, of the first reactant gas flow creating means, 36. This adjustment of such a variable ratio drive means, 39, can be done by hand or automatically, for example in response to a measurement of the volumetric heating value of the product volatile matter in gas mixture by a gas calorimeter. Maximum volumetric heating value of the product volatile matter in reactant gas mixture occurs at or near an equivalence ratio of 1.0 for the mixture. When other equivalence ratios are to be used a calibrated sensor can be used to measure the ratio of volatile matter to oxygen of the product volatile matter in reactant gas mixture. The output of this sensor can operate via a control means to control the proportion of reactant gas flow into the volatile matter distillation zone to the reactant gas flow into the rapid reaction zone. In this way the equivalence ratio of the product volatile matter in reactant gas mixture can be held to the desired value.
4. The mass rate of removal of product producer gas from the char fuel reaction chamber can be controlled by hand or automatically by control of the third producer gas flow creating means, 45. A mass flow rate sensor on the first separate container gas inlet, 3, into the rapid reaction zone can act via a control means to proportionally adjust producer gas removal rate by adjusting the flow rate adjustment means, 46, of the third producer gas flow creating means, 45. Alteratively for those cross flow char fuel gasifiers which are to be operated at essentially steady pressure in the char fuel reaction chamber, a chamber pressure sensor can act via a control means to adjust producer gas removal rate so that chamber pressure remains essentially constant.
5. The mass rate of removal of product volatile matter in gas mixture from the char fuel reaction chamber can be proportioned to the mass rate of removal of product producer gas, as by adjusting the fourth volatile matter in gas mixture flow creating means, 47, the flow rate adjustment, 48, connecting to the flow rate adjustment means, 46, of the third product producer gas flow creating means, 45. We seek in this adjustment of relative product gas removal rates to prevent crossover flow, either of producer gas into the volatile matter in gas mixture, or of volatile matter in gas mixture into the producer gas.

When producer gas crosses over into the volatile matter in gas mixture the latter product will contain carbon monoxide which would not otherwise be present. When volatile matter in gas mixture crosses over into the producer gas the latter product may contain hydrocarbon or tar type materials which would not otherwise be present. Thus we can use a carbon monoxide sensor on the volatile matter in gas mixture outlet, 6, together with a volatile matter tar or hydrocarbon sensor on the producer gas outlet, 5, to act via a control means to adjust the flow rate adjustment means, 48, to minimize or prevent such undesirable crossover flow.

6. In these various ways the product gas output of a cross flow char fuel gasifier can meet the demand and desired proportions maintained between the several reactants and products.

One particular example of a control and sensor means for automatically controlling the operation of a cross flow char fuel gas producer of this invention by controlling the several gas flow rates is shown schematically in FIG. 2 and comprises the following:

a. A means for sensing, 49, the mass flow rate of the first reactant gas into the rapid reaction zone is placed on the first reactant gas inlet, 3. The mass flow rate of first reactant gas into the rapid reaction zone can be adjusted by adjusting the flow rate adjusting means, 38, of the first reactant gas flow creating means, 36, for delivering reactant gas into the rapid reaction zone. This adjustment sets the basic rate of char fuel gasification into producer gas by setting the mass flow rate of reactant gas into the rapid reaction zone.
b. A means for sensing, 50, the equivalence ratio of the volatile matter in reactant gas mixture is placed on the second separate outlet, 6, from the volatile matter in reactant gas mixture manifold.
c. A control means, 51, for controlling the mass flow rate of reactant gas into the volatile matter distillation zone is responsive to the equivalence ratio sensor means, 50, and is operative on the flow rate adjusting means, 39, of the second reactant gas flow creating means, 37, for delivering reactant gas into the volatile matter distillation zone, so that an essentially constant equivalence ratio is achieved in the product volatile matter in reactant gas mixture.
d. A sensor means, 52, for sensing the level of char fuel within the char fuel reaction chamber is placed on the reaction chamber. The control means, 51, can also be responsive to this char fuel level sensor and operative upon the refuel mechanism, 7, so that the reaction chamber is maintained essentially full of char fuel.
e. A sensor means, 53, for sensing the pressure within the char fuel reaction chamber is placed thereon. The control means, 51, can also be responsive to this pressure sensor anti operative upon the flow rate adjustment means, 46, of the third product producer gas flow creating means, 45, so that all product producer gas created within the rapid reaction zone is continuously removed therefrom.
f. A sensor means, 54, for sensing the carbon monoxide content of the product volatile matter in reactant gas mixture is placed on the second separate outlet, 6, from the volatile matter in reactant gas mixture manifold. Another sensor means, 55, for sensing the volatile matter or tar content of the product producer gas is placed on the first separate outlet, 5, from the producer gas manifold. The control means, 51, can additionally be responsive to these carbon monoxide and volatile matter sensor means and operative upon the flow rate adjustment means, 48, of the fourth means for creating a flow of product volatile matter in reactant gas mixture, 47, from its manifold, so that essentially only producer gas flows into the producer gas manifold and essentially only volatile matter in reactant gas mixture flows into its manifold. In this way crossover flow of the two product gases is largely prevented.

Figure 3:
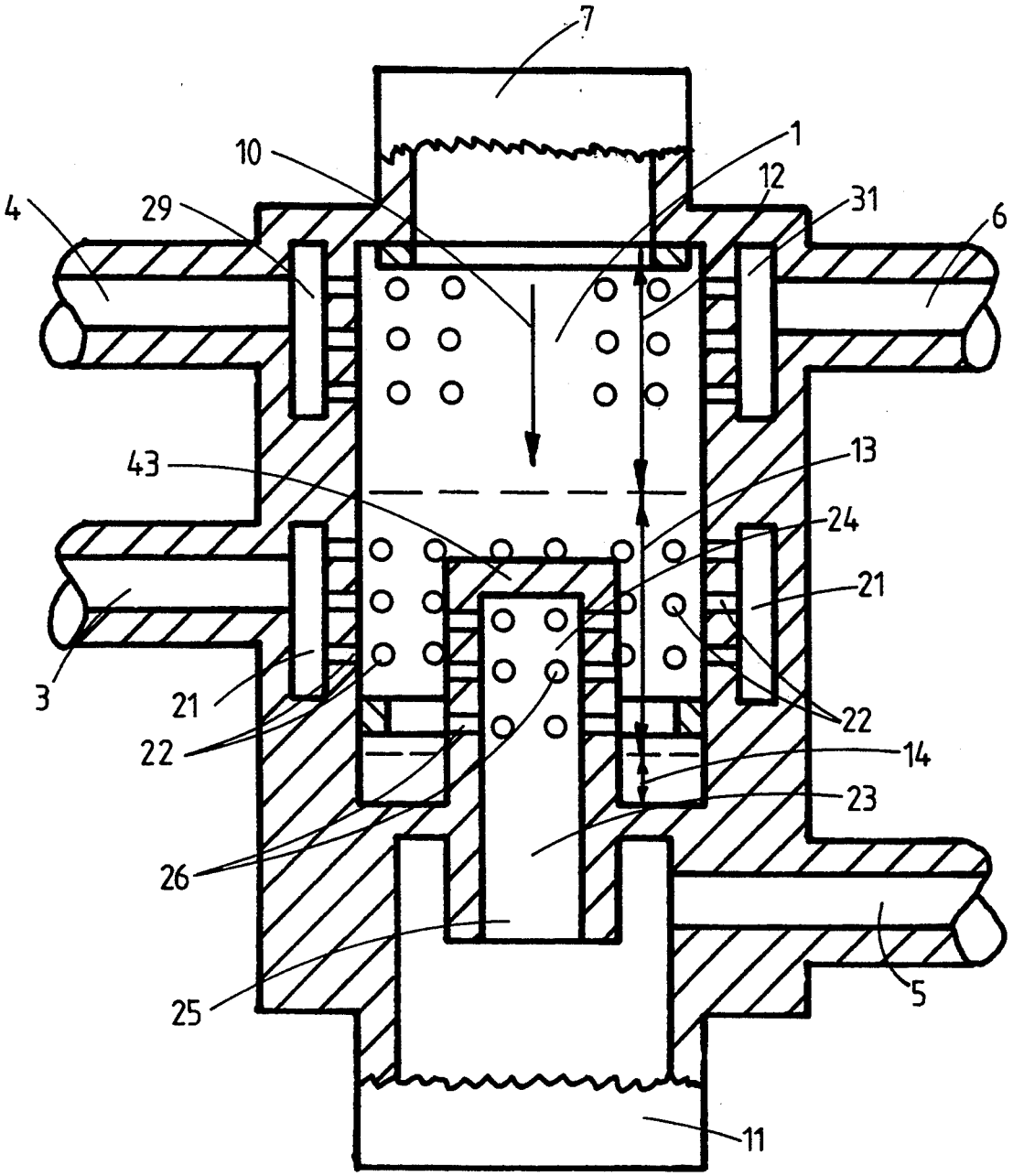
FIG. 3 is another sectional view of the char fuel reaction chamber of the invention.

Another form of this invention, similar to the form shown in FIG. 1 and FIG. 2, is shown in FIG. 3, wherein the inlet, 24, to the producer gas manifold, 23, is positioned radially centrally within the ash collection zone, 14, and the rapid reaction zone, 13. The producer gas outlet ports, 26, are positioned along the length of the primary reaction chamber, 1, in the direction of char fuel motion, 10, which is adjacent to the rapid reaction zone, 13. These producer gas outlet ports, 26, can be positioned angularly uniformly around the periphery of the inlet, 24, and are at right angles to the char fuel motion direction, 10, so that fuel particles will not tend to be pushed through these producer gas outlet ports. With this centrally positioned inlet to the producer gas manifold, 23, ash particles will carry over through the ports, 26, into the manifold, 23, and the ash removal mechanism, 11, is thus positioned to remove ashes collected in the producer gas manifold, 23. Preferably that portion of the first reactant gas manifold outlet, 21, with first reactant gas inlet ports, 22, into the rapid reaction zone, 13, uses as an inlet portion of the periphery of the primary reaction chamber, 1, essentially the full periphery so that the first reactant gas manifold, 19, wraps fully round the primary reactor, 1, adjacent to the rapid reaction zone. In this way air, or other reactant gas, flows radially across the direction of char fuel motion, 10, essentially angularly uniformly and the resulting producer gas exits from the central portions of the rapid reaction zone. With this radial cross flow pattern the char fuel volume in the rapid reaction zone which receives unreacted reactant gas is increased. The top, 43, of the inlet, 24, to the producer gas manifold, 23, is capped to prevent char fuel entering therein and thus bypassing the rapid reaction zone, 13.

The outlet, 25, from the producer gas manifold, 23, is preferably arranged, as shown in FIG. 3, to cause the producer gas to turn through an angle of about 180°. This gas flow turning acts to separate ash particles from the gas by centrifugal force and deposit these ash particles toward the ash removal mechanism, 11, and is an example of a means for separating solid and liquid particles from the product producer gas. Similar means for separating solid and liquid particles from the producer gas can also be used with producer gas manifolds positioned on one side of the char fuel reaction chamber as shown in FIG. 1. In this case an ash removal means is positioned on the producer gas manifold.

For those char fuel gas producer applications where improved separation is sought of the volatile matter in reactant gas mixture from the rapid reaction zone and from the producer gas, a gap, 44, can be introduced between the lowest second reactant gas inlet ports, 30, of the second reactant gas manifold, 27, as well as the lowest gas mixture outlet ports, 34, of the volatile matter in reactant gas mixture manifold, 31, and the upper first reactant gas inlet ports, 22, of the first reactant gas manifold, 19, as well as the upper producer gas outlet ports, 26, of the producer gas manifold, 23, as shown in FIG. 1. As the char fuel moves along in the char fuel motion direction, 10, through the volatile matter distillation and char fuel preheat zone, 12, the volatile matter is progressively removed. As a result at the bottom of the volatile matter distillation zone, 12, the char fuel no longer contains appreciable volatile matter and is there being preheated prior to entry into the rapid reaction zone, 13. There is thus no necessity of passing appreciable reactant gas through this lower portion of the volatile matter distillation and char fuel preheat zone. The gap, 44, reduces reactant gas flow through this bottom portion and thus prevents entry of volatile matter in reactant gas mixture into the rapid reaction zone. The gas within the bottom portion of the char fuel preheat zone is also essentially free of volatile matter and this gas thus shields the overlying volatile matter in air mixture from being ignited by the hot char fuel in the rapid reaction zone.

Oxygen enrichment of reactant gas has been used in prior art gas producers in order to create a producer gas of higher volumetric heating value. Such oxygen enrichment reduces the content of diluent nitrogen in the product producer gas. The cross flow char fuel gas producers of this invention are particularly well suited to the efficient use of oxygen enrichment. Such oxygen enriched reactant gas can be the first reactant gas source, 17, for reactant gas being delivered into the rapid reaction zone, 13, where the producer gas is being generated as shown in FIGS. 1 and 2. In this wa the oxygen enriched reactant gas is used only in the rapid reaction zone, where desired, and is delivered directly thereinto.

Some evidence suggests that the reduction of tar formation, brought about by mixing air into the volatile matter being distilled out of the char fuel in the volatile matter distillation zone, is in part due to oxygen gas reacting with volatile matter. The resulting partially oxidized volatile matter apparently forms little or no tar. Hence oxygen enrichment of that reactant gas being delivered into the volatile matter distillation and char fuel preheat zone can also be used with the devices of this invention in the same manner as described hereinabove.

Having thus described my invention, what I claim is:

1. A cross flow char fuel gas producer comprising:

a container comprising: a char fuel reaction chamber comprising a refuel end and an ash collection end, a direction of char fuel motion from said refuel end toward said ash collection end, at least two separate inlets into said container, a first separate container inlet and a second separate container inlet, at least two separate outlets from said container, a first separate container outlet and a second separate container outlet;

a source of char fuel particles:

a refuel mechanism means for placing char fuel particles from said source of char fuel particle into said char fuel reaction chamber via the refuel end thereof;

at least one means for removing ashes from said char fuel reaction chamber;

means for preheating said char fuel particles within said char fuel reaction chamber to a rapid reaction temperature at which said char fuel particles react sufficiently rapidly with oxygen in reactant gases, when said char fuel gas producer is being started, that the char fuel temperature does not decrease when said means for preheating is turned off;

at least one source of reactant gas containing appreciable oxygen gas, said appreciable oxygen gas content being that content required to react sufficiently rapidly with said char fuel particles, when said char fuel gas producer is being started, that the char fuel particles temperature does not decrease from the rapid reaction temperature when said means for preheating said char fuel is turned off;

wherein said char fuel reaction chamber further comprises: a volatile matter distillation and char fuel preheat zone positioned toward said refuel end of said chamber, an ash collection zone positioned toward said ash collection end of said chamber, a rapid reaction zone positioned between said volatile matter distillation and char fuel preheat zone and said ash collection zone, a peripheral dimension around the outer surface of said char fuel reaction chamber at right angles to said char fuel motion direction;

said peripheral dimension of said char fuel reaction chamber comprising an inlet portion, a separate outlet portion, and separate sealed portions without ports;

a first reactant gas manifold comprising a first reactant gas manifold inlet and a first reactant gas manifold outlet, said first reactant gas manifold outlet connecting to first reactant gas inlet ports into said rapid reaction zone of said char fuel reaction chamber, and said first reactant gas inlet ports being positioned along the length of said char fuel reaction chamber in said direction of char fuel motion which is adjacent to said rapid reaction zone, and said first reactant gas inlet ports also being positioned around only said inlet portion of said peripheral dimension of said char fuel reaction chamber, said first reactant gas manifold inlet connecting to said first separate container inlet;

a producer gas manifold comprising a producer gas manifold inlet and a producer gas manifold outlet, said producer gas manifold inlet connecting to producer gas outlet ports out of said rapid reaction zone of said char fuel reaction chamber, and said producer gas outlet ports being positioned along the length of said char fuel reaction chamber in said direction of char fuel motion which is adjacent to said rapid reaction zone, and said producer gas outlet ports also being positioned around only said outlet portion of said peripheral dimension of said char fuel reaction chamber, said producer gas manifold outlet connecting to said first separate container outlet;

a second reactant gas manifold comprising a second reactant gas manifold inlet and a second reactant gas manifold outlet, said second reactant gas manifold outlet connecting to second reactant gas inlet ports into said volatile matter distillation and char fuel preheat zone of said char fuel reaction chamber, and said second reactant gas inlet ports being positioned along the length of said char fuel reaction chamber in said direction of char fuel motion which is adjacent to said volatile matter distillation and char fuel preheat zone, and said second reactant gas inlet ports also being positioned around only said inlet portion of said peripheral dimension of said char fuel reaction chamber, said second reactant gas manifold inlet connecting to said second separate container inlet;

a volatile matter in reactant gas mixture manifold comprising a volatile matter in reactant gas mixture manifold inlet and a volatile matter in reactant gas mixture manifold outlet, said volatile matter in reactant gas mixture manifold inlet connecting to volatile matter in gas mixture outlet ports out of said volatile matter distillation and char fuel preheat zone of said char fuel reaction chamber, and said volatile matter in gas mixture outlet ports being positioned along the length of said char fuel reaction chamber in said direction of char fuel motion which is adjacent to said volatile matter distillation and char fuel preheat zone, and said volatile matter in gas mixture outlet ports also being positioned around only said outlet portion of said peripheral dimension of said char fuel reaction chamber, said volatile matter in reactant gas mixture manifold outlet connecting to said second separate container outlet;

wherein said reactant gas inlet ports of said first reactant gas manifold are positioned at right angles to said char fuel motion direction and across from said producer gas outlet ports of said producer gas manifold;

wherein said reactant gas inlet ports of said second reactant gas manifold are positioned at right angles to said char fuel motion direction and across from said volatile matter in gas mixture outlet ports of said volatile matter in reactant gas manifold;

a first means for providing a first flow of reactant gas, from said at least one source of reactant gas containing appreciable oxygen gas, into said first reactant gas manifold via said first separate container inlet, and comprising first means for adjusting a flow rate of said first flow of reactant gas:

a second means for providing a second flow of reactant gas from said at least one source of reactant gas containing appreciable oxygen gas, into said second reactant gas manifold via said second separate container inlet and comprising second means for adjusting a flow rate of said second flow of reactant gas;

a producer gas product collector;

a volatile matter in gas mixture product collector;

said first separate container outlet connecting only to said producer gas product collector;

said second separate container outlet connecting only to said volatile matter in gas product collector;

a third means for providing a flow of product producer gas, from said producer gas manifold, into said producer gas product collector via said first separate container outlet, and comprising third means for adjusting a flow rate of said product producer gas;

a fourth means for providing a flow of product volatile matter in gas mixture, from said volatile matter in gas mixture manifold, into said volatile matter in gas mixture product collector via said second separate container outlet, and comprising fourth means for adjusting a flow rate of said volatile matter in gas mixture product.

2. A cross flow char fuel gas producer as described in claim 1:

wherein said first and second flows of reactant gas are from a common reactant gas source.

3. A cross How char fuel gas producer as described in claim 1:

wherein said first and second reactant gas inlet ports, said producer gas outlet ports, and said volatile matter in gas mixture outlet ports have area cross section smaller than area cross section of the char fuel particles being refueled into said char fuel reaction chamber.

4. A cross flow char fuel gas producer as described in claim 1:

wherein said first reactant gas inlet ports connecting to said outlet of said first reactant gas manifold are separated from said second reactant gas inlet ports connecting to said outlet of said second reactant gas manifold by an unported gap in said direction of char fuel motion.

5. A cross flow char fuel gas producer as described in claim 1:

wherein said producer gas manifold inlet of said producer gas manifold is positioned centrally within said ash collection zone and said rapid reaction zone;

wherein said producer gas outlet ports are positioned along the length of said char fuel reaction chamber, in said direction of char fuel motion, which is adjacent to said rapid reaction zone, and angularly uniformly around the periphery of said producer gas manifold inlet at right angles to said char fuel motion direction.

6. A cross flow char fuel gas producer as described in claim 1 wherein:

said producer gas manifold further comprises means for separating solid and liquid particles from said producer gas;

said means for removing ashes comprises means for removing collected solid and liquid materials from said producer gas manifold.

7. A cross flow char fuel gas producer as described in claim 5 wherein:

said producer gas manifold further comprises means for separating solid and liquid particles from said producer gas;

said means for removing ashes comprises means for removing collected solid and liquid materials from said producer gas manifold.

8. A cross flow char fuel gas producer as described in claim 1 wherein said at least one source of reactant gas comprising:

two sources of reactant gas containing appreciable oxygen gas, a first reactant gas source and a second reactant gas source, said second reactant gas differing in composition from said first reactant gas;

wherein said first means for providing a flow of reactant gas provides a first flow of reactant gas from said first reactant gas source into said first reactant gas manifold via said first separate container inlet;

wherein said second means for providing a flow of reactant gas provides a second flow of reactant gas from said second reactant gas source into said second reactant gas manifold via said second separate container inlet.

9. A cross flow char fuel gas producer as described in claim 8:

wherein said first reactant gas comprises a proportion of oxygen gas at least equal to the oxygen content of air.

10. A cross flow char fuel gas producer as described in claim 8:

wherein said first reactant gas comprises steam.

11. A cross flow char fuel gas producer as described in claim 1 and further comprising:

first sensor means for sensing the composition of the product producer gas;

second sensor means for sensing the composition of the product volatile matter in gas mixture;

control means for controlling: said first flow rate of reactant gas into said first reactant gas manifold; said second flow rate of reactant gas into said second reactant gas manifold; said flow rate of product producer gas from said producer gas manifold; said flow rate of product volatile matter in gas mixture from said volatile matter in gas mixture manifold; said control means being responsive to said first sensor means for sensing the composition of the product producer gas and to said second sensor means for sensing the composition of the product volatile matter in gas mixture; said control means being operative upon: said third means for adjusting the flow rate of said product producer gas; said fourth means for adjusting the flow rate of said volatile matter in gas mixture product; said first means for adjusting the flow rate of said first flow of reactant gas; said second means for adjusting the flow rate of said second flow of reactant gas, so that product producer gas flows into said producer gas manifold and product volatile matter in gas mixture flows into said volatile matter in gas mixture manifold from said char fuel reaction chamber.

* * * * *